US011630423B2

(12) United States Patent
Débois et al.

(10) Patent No.: US 11,630,423 B2
(45) Date of Patent: Apr. 18, 2023

(54) PACKAGING FOR CLOCK HANDS

(71) Applicant: Universo S.A., La Chaux-de-Fonds (CH)

(72) Inventors: Marine Débois, Morteau (FR); Gerard Rossier, La Chaux-de-Fonds (CH)

(73) Assignee: Universo S.A., La Chaux De-Fonds (CH)

( * ) Notice: Subject to any disclaimer, the term of this patent is extended or adjusted under 35 U.S.C. 154(b) by 195 days.

(21) Appl. No.: 17/125,104

(22) Filed: Dec. 17, 2020

(65) Prior Publication Data

US 2021/0294272 A1 Sep. 23, 2021

(30) Foreign Application Priority Data

Mar. 19, 2020 (EP) ..... 20164238

(51) Int. Cl.
*G04D 1/06* (2006.01)
*B65B 5/08* (2006.01)
(Continued)

(52) U.S. Cl.
CPC ..... *G04D 1/066* (2013.01); *B65B 5/08* (2013.01); *B65B 57/10* (2013.01); *B65D 19/004* (2013.01);
(Continued)

(58) Field of Classification Search
CPC ..... G04D 3/0272; G04D 1/06; G04D 1/066; G04D 3/0092; B65D 2519/00955;
(Continued)

(56) References Cited

U.S. PATENT DOCUMENTS 3,120,825 A * 2/1964 Johnson ..... B65D 19/004 108/53.3
4,799,588 A * 1/1989 Trisl ..... A47F 7/024 206/564
2003/0089285 A1* 5/2003 Carson ..... B65D 19/004 108/901

FOREIGN PATENT DOCUMENTS

EP 2 799 940 A1 11/2014
EP 3 336 615 A1 6/2018
(Continued)

OTHER PUBLICATIONS

European Search Report for corresponds to EP 20 16 4238, dated Sep. 24, 2020.

(Continued)

*Primary Examiner* — Rafael A Ortiz
(74) *Attorney, Agent, or Firm* — Sughrue Mion, PLLC

(57) ABSTRACT

Packaging (1) for clock hands (2) with a pipe (4) and a body (5), including a pallet (10) for receiving, holding, storing and carrying hands (2) having the same height, including bores (11) for receiving the pipes (4) according to a constant pitch, adjacent to recesses (12) for housing the hand bodies (5) resting on an upper surface (13), each pallet (10) including a position index device (20), and a spacer (15) for cooperating such that it bears against a lower surface (14) of another pallet (10) and extending, from the upper surface (13), over a height which exceeds that of the hand bodies (5), each pallet (10) having a transverse bearing surface (130) for receiving the bearing surfaces (3) of the hands (2), and, parallel thereto, oblong pieces (131), the width whereof is adapted for the insertion of robotic grippers or tweezers for loading/unloading hands.

24 Claims, 9 Drawing Sheets

(51) Int. Cl.

| | |
|---|---|
| ***B65B 57/10*** | (2006.01) |
| ***B65D 19/00*** | (2006.01) |
| ***B65D 85/40*** | (2006.01) |
| ***G04D 3/00*** | (2006.01) |

(52) U.S. Cl.
CPC ..... *B65D 85/40* (2013.01); *G04D 3/0092* (2013.01); *B65D 2519/00268* (2013.01); *B65D 2519/00288* (2013.01); *B65D 2519/00318* (2013.01); *B65D 2519/00338* (2013.01); *B65D 2519/00815* (2013.01); *B65D 2519/00955* (2013.01)

(58) Field of Classification Search
CPC ..... B65D 2519/00815; B65D 85/40; B65D 19/004; B65B 57/10; B65B 5/08
USPC ..... 206/301
See application file for complete search history.

(56) References Cited

FOREIGN PATENT DOCUMENTS

| | | | | |
|---|---|---|---|---|
| GB | 2099191 A | * | 12/1982 | ..... G04B 19/042 |
| JP | 54-180425 U | | 12/1976 | |
| JP | 2018-096989 A | | 6/2018 | |

OTHER PUBLICATIONS

Communication dated Mar. 9, 2021, from the Japanese Patent Office in application No. 2020210127.

* cited by examiner

PACKAGING FOR CLOCK HANDS

CROSS REFERENCE TO RELATED APPLICATIONS

This application claims priority to European patent application no. 20164238.6 filed Mar. 19, 2020, the entire contents of which are incorporated herein by reference.

FIELD OF THE INVENTION

The invention relates to a packaging for clock hands, each of said hands comprising at least one pipe defining a hand axis, a bearing surface connected to the pipe and substantially perpendicular to the hand axis, and a hand body that is substantially radial relative to the pipe, said packaging comprising at least one pallet provided for receiving, holding, storing and carrying said hands having the same hand height, said at least one pallet comprising a series of bores for receiving said pipes according to a constant pitch, each said bore being adjacent to a recess arranged to house one said hand body resting on an upper pallet surface opposite a lower pallet surface.

The invention further relates to an automated production means for manufacturing such clock hands, said automated production means comprising at least one stamping and/or milling and/or diamond cutting manufacturing unit.

The invention further relates to a method for manufacturing such clock hands.

The invention relates to the field of manufacturing small horological display components, in particular hands and the like.

BACKGROUND OF THE INVENTION

The manufacture of small horological display components, such as hands and the like, is always delicate, as these small components, which are difficult to handle without scratching, are aesthetic parts that determine, at first glance, the level of finish and quality of a watch or a timepiece. When such components are made of precious metal, it is important not to lose them in amongst the shavings or in a treatment or washing bath.

The usual technique involves inserting the hands on perforated and slit paper cards, grouped together inside boxes. Insertion is carried out manually by threading, which can deform the hand and cause damage thereto from friction against the paper; removing the hand is subject to the same risks. Such a paper support makes it difficult to correctly carry out and complete inspection operations, operations involving correcting the pipe diameter or operations for deburring to correct the geometrical configuration of the hand body, due to the lack of a rigid bearing surface beneath the hand. Any automation project with such a support is thus difficult to achieve.

SUMMARY OF THE INVENTION

The invention proposes developing a packaging which, from the initial shaping operation, generally carried out by stamping and/or machining, but which can also come from foundry or three-dimensional printing methods, for hands or small display components for timepieces having a geometrical configuration that is similar to that of hands, provides for the collection of the blanks, the intermediate storage thereof during all operations in the manufacturing process thereof, and the washing thereof, these components preferably remaining permanently on the packaging tool according to the invention once initial shaping has been carried out.

For this purpose, the invention relates to a packaging according to claim 1. The invention further relates to an automated production means for manufacturing such clock hands, said automated production means comprising at least one stamping and/or milling and/or diamond cutting manufacturing unit, according to claim 19.

The invention further relates to a method for manufacturing such clock hands according to claim 23.

BRIEF DESCRIPTION OF THE DRAWINGS

Other features and advantages of the invention will be better understood upon reading the following detailed description given with reference to the accompanying drawings, in which.

DETAILED DESCRIPTION OF THE PREFERRED EMBODIMENTS

Figure 2:
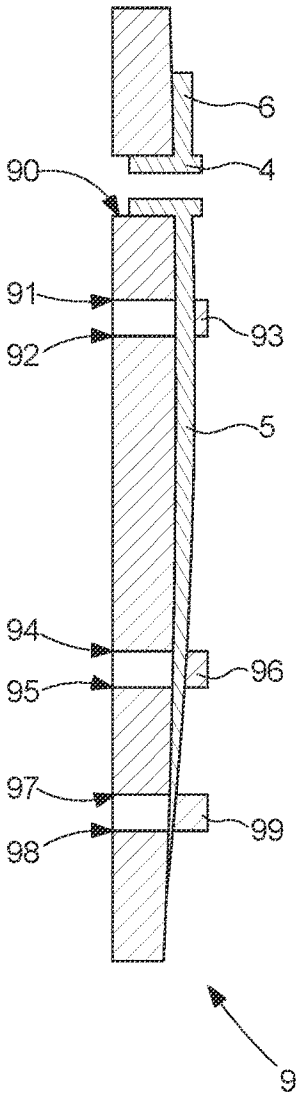
FIG. 2 diagrammatically shows a sectional view, through the hand, of the assembly in FIG. 1 comprising a card and a hand.
Figure 1:
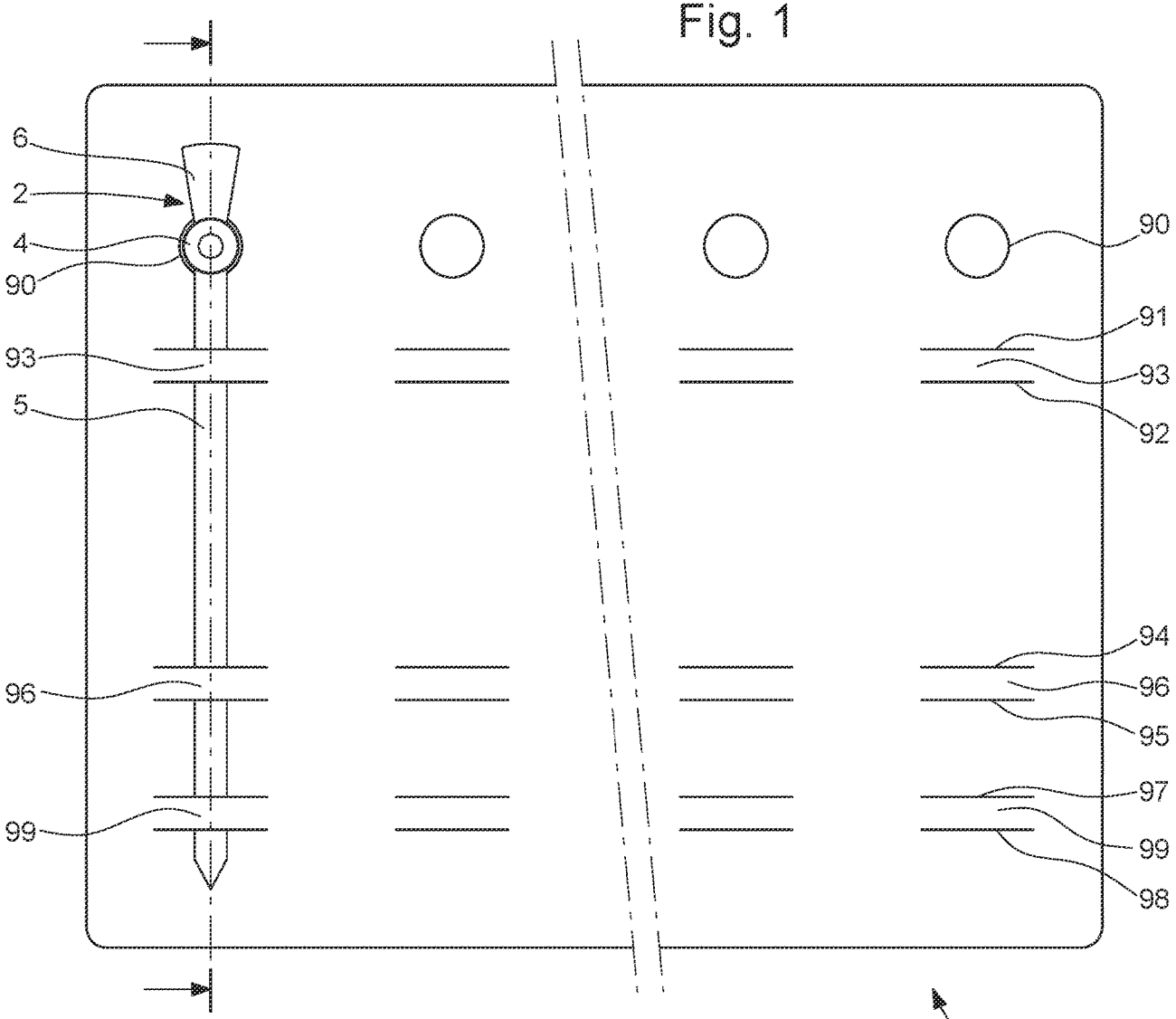
FIG. 1 diagrammatically shows an overhead view of a paper card, according to the prior art, comprising holes for passing the pipes, and slots for inserting the hand bodies, a hand being shown in the threaded position thereof.
Figure 3:
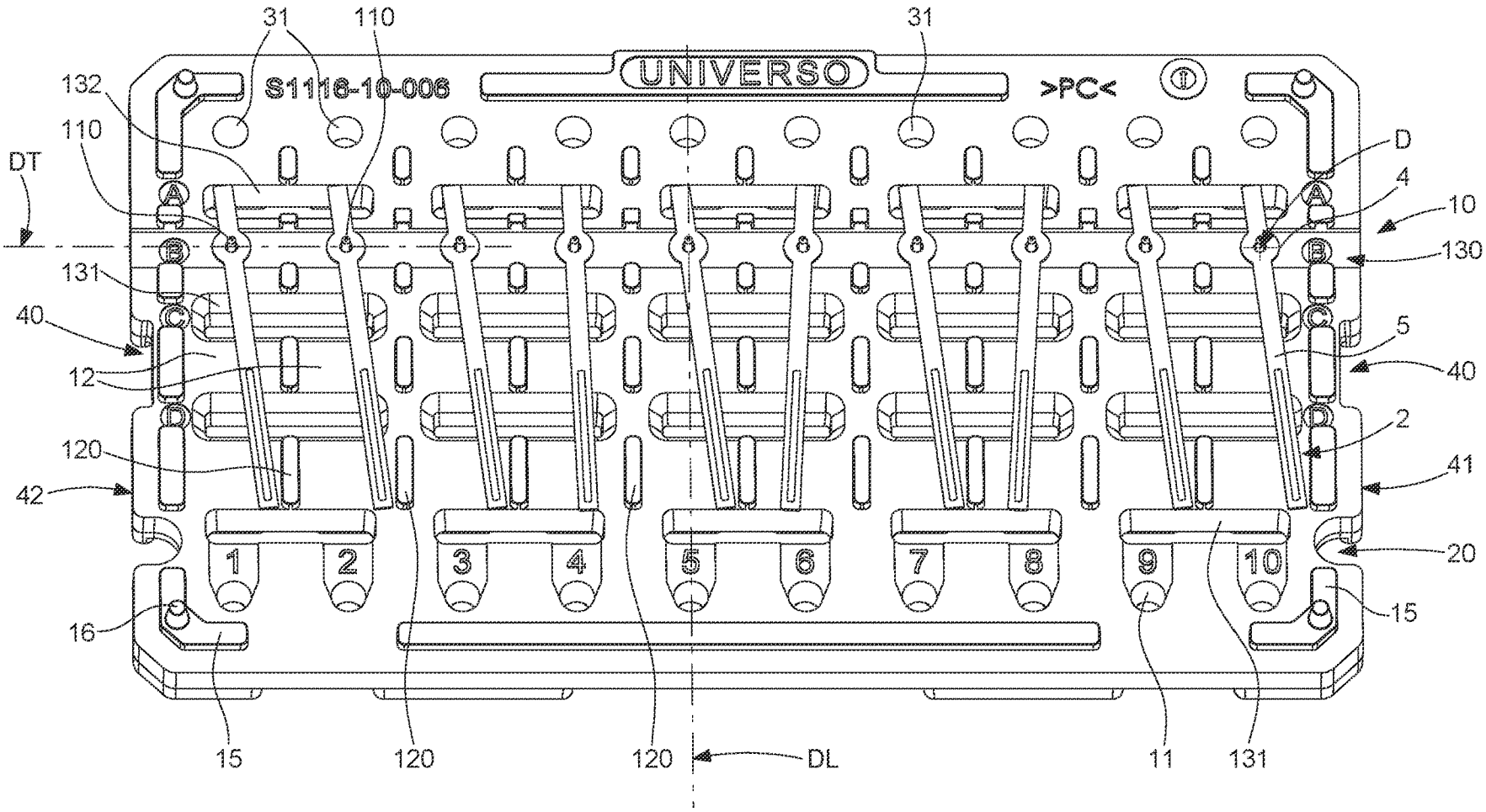
FIG. 3 diagrammatically shows a perspective, overhead view of a first alternative embodiment of a pallet constituting a packaging according to the invention, on which a plurality of hands is positioned.
Figure 4:
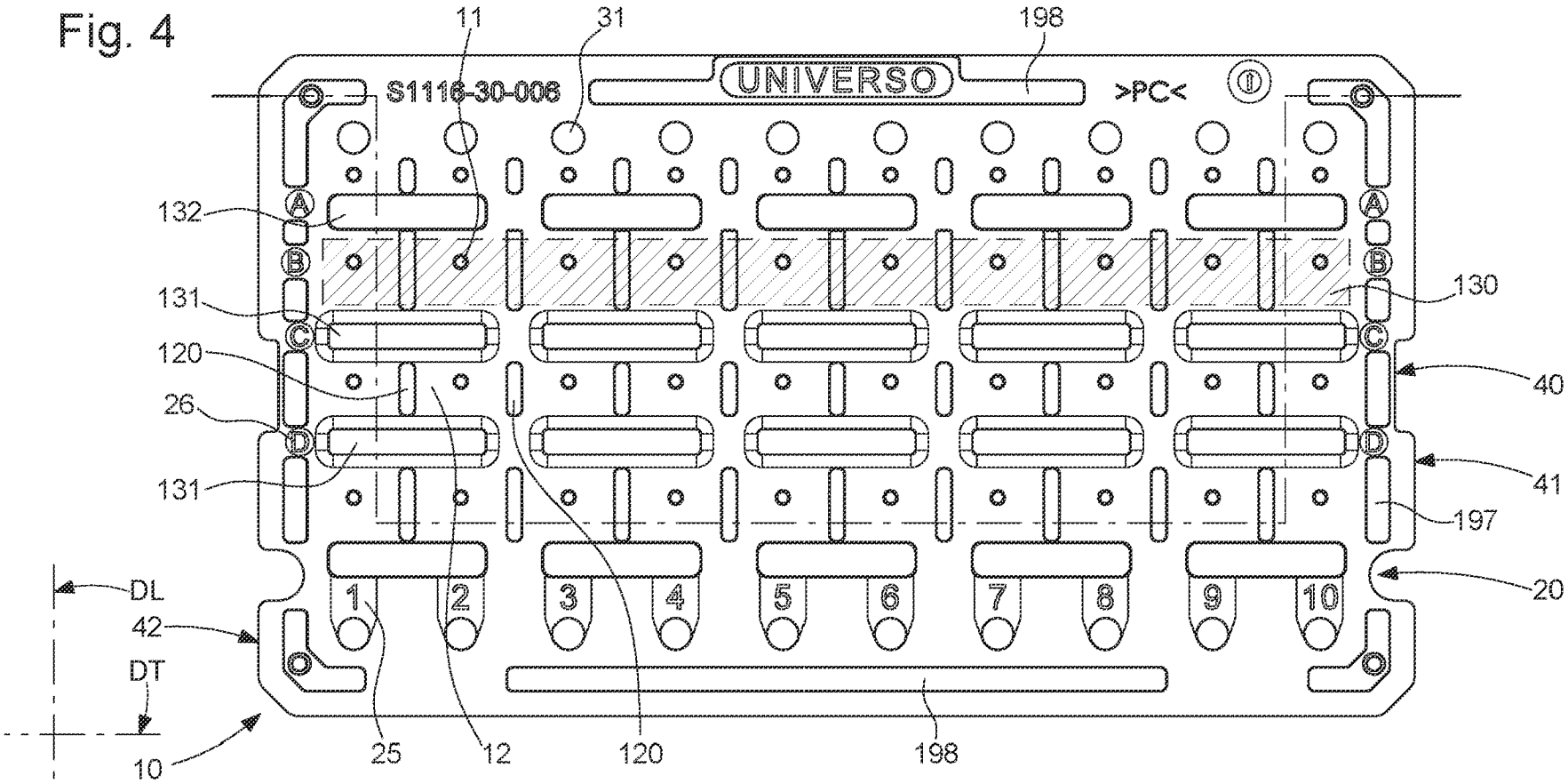
FIG. 4 diagrammatically shows an overhead view of a second alternative embodiment of a pallet constituting a packaging according to the invention.
Figure 5:
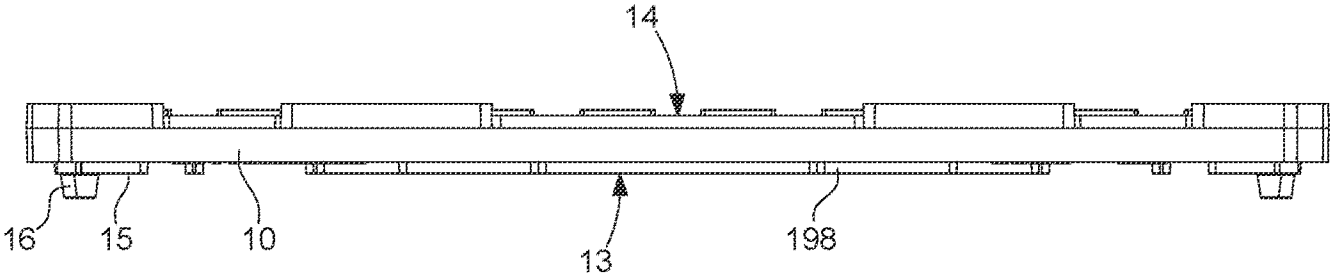
FIG. 5 diagrammatically shows a lengthwise side view of the pallet in FIG. 4.
Figure 6:
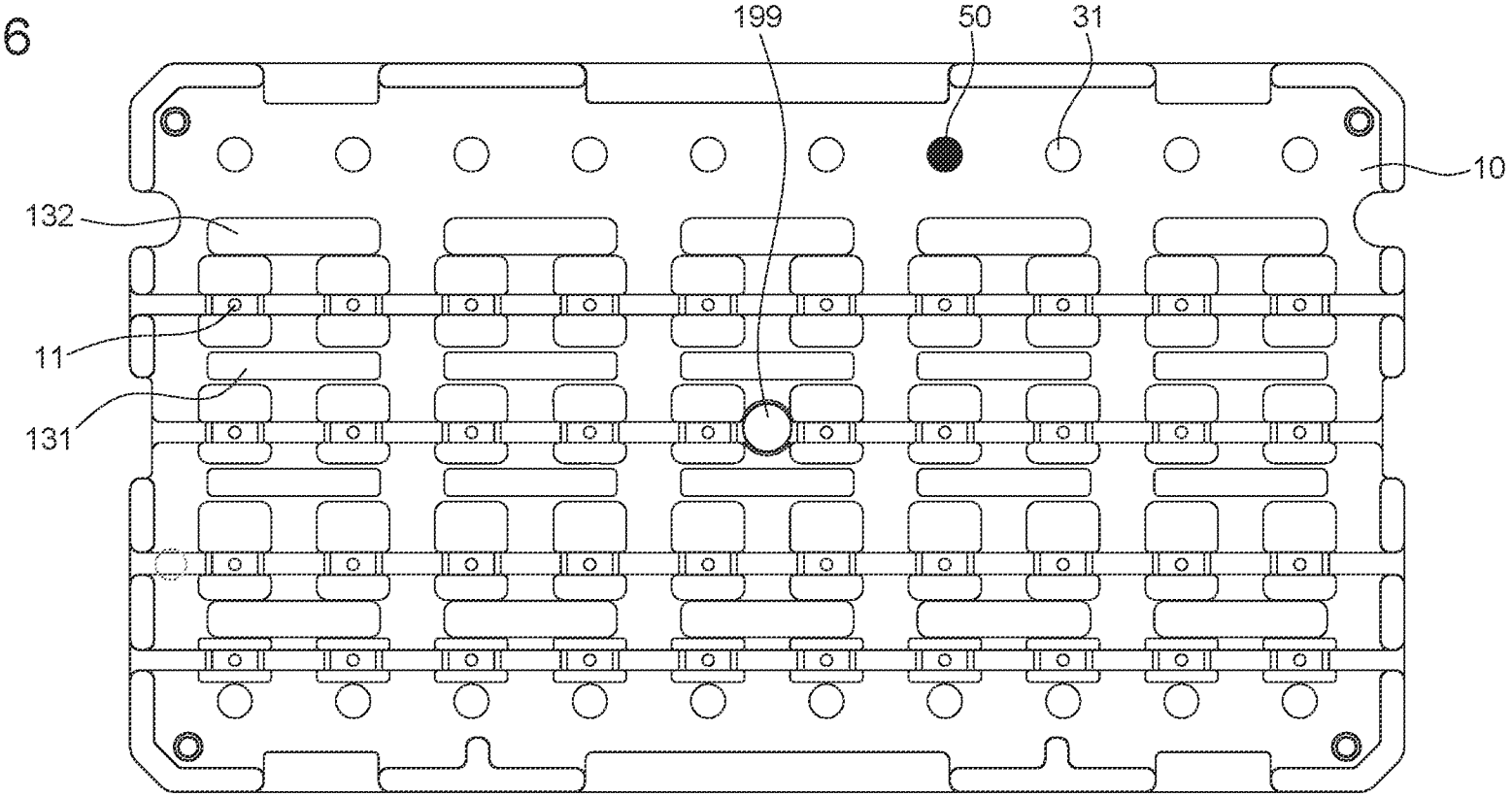
FIG. 6 diagrammatically shows a view from below of the pallet in FIG. 4.
Figure 7:
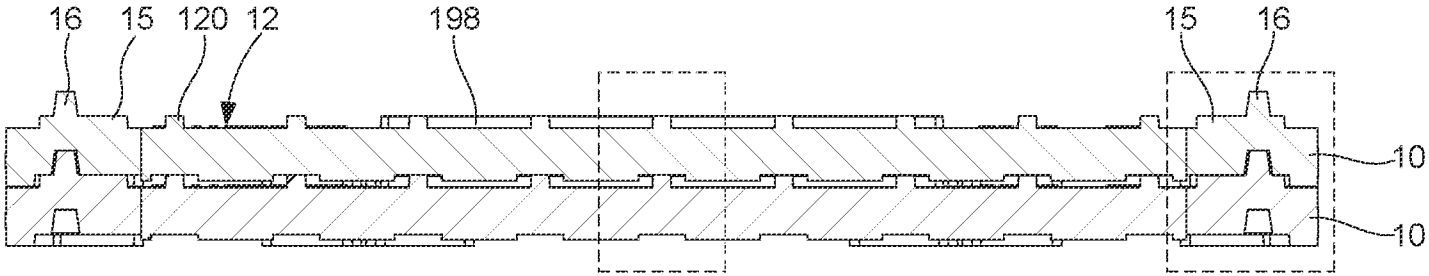
FIG. 7 diagrammatically shows a lengthwise sectional view, according to FIG. 4, of an assembly of two pallets according to FIG. 4.
Figure 12:
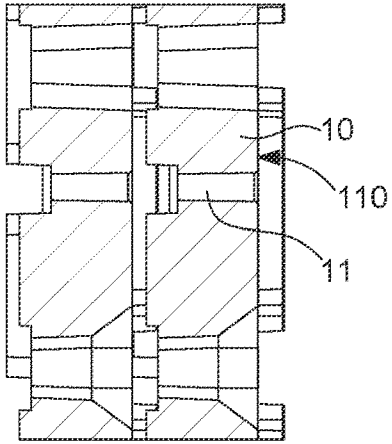
FIGS. 8, 9, 11 and 12 are detailed views of that shown in FIG. 7.
Figure 11:
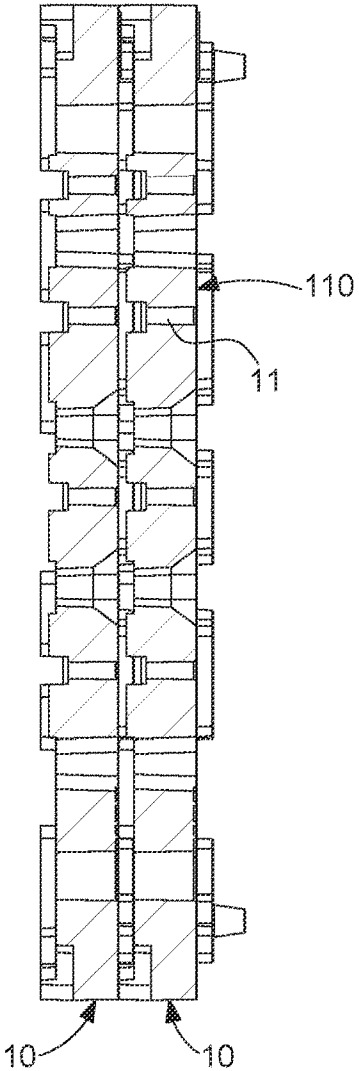
Figure 10:
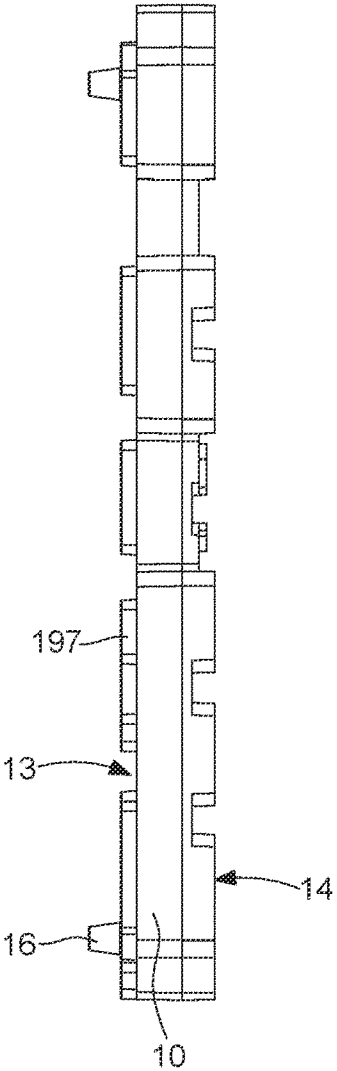
FIG. 10 diagrammatically shows a widthwise side view of the pallet in FIG. 4.
Figure 8:
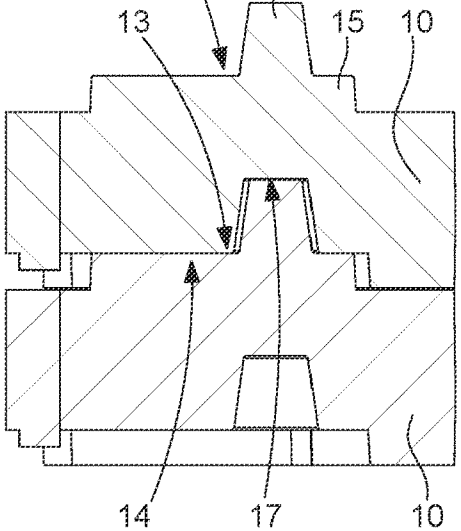
Figure 9:
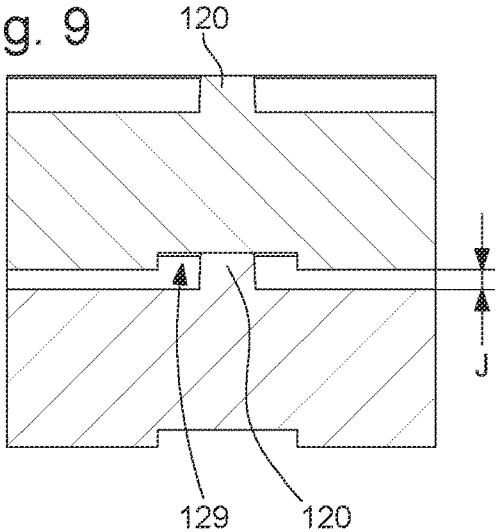
Figure 14:
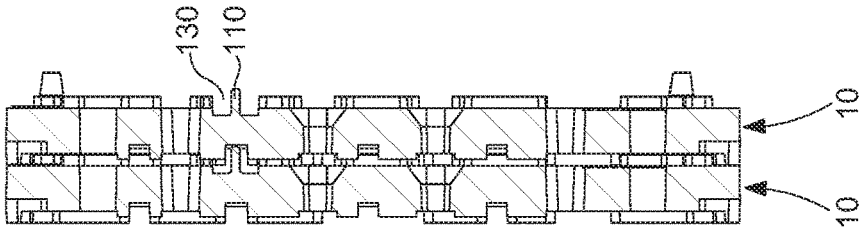
FIG. 14 diagrammatically shows a widthwise sectional view of an assembly of two pallets according to FIG. 13.
Figure 13:
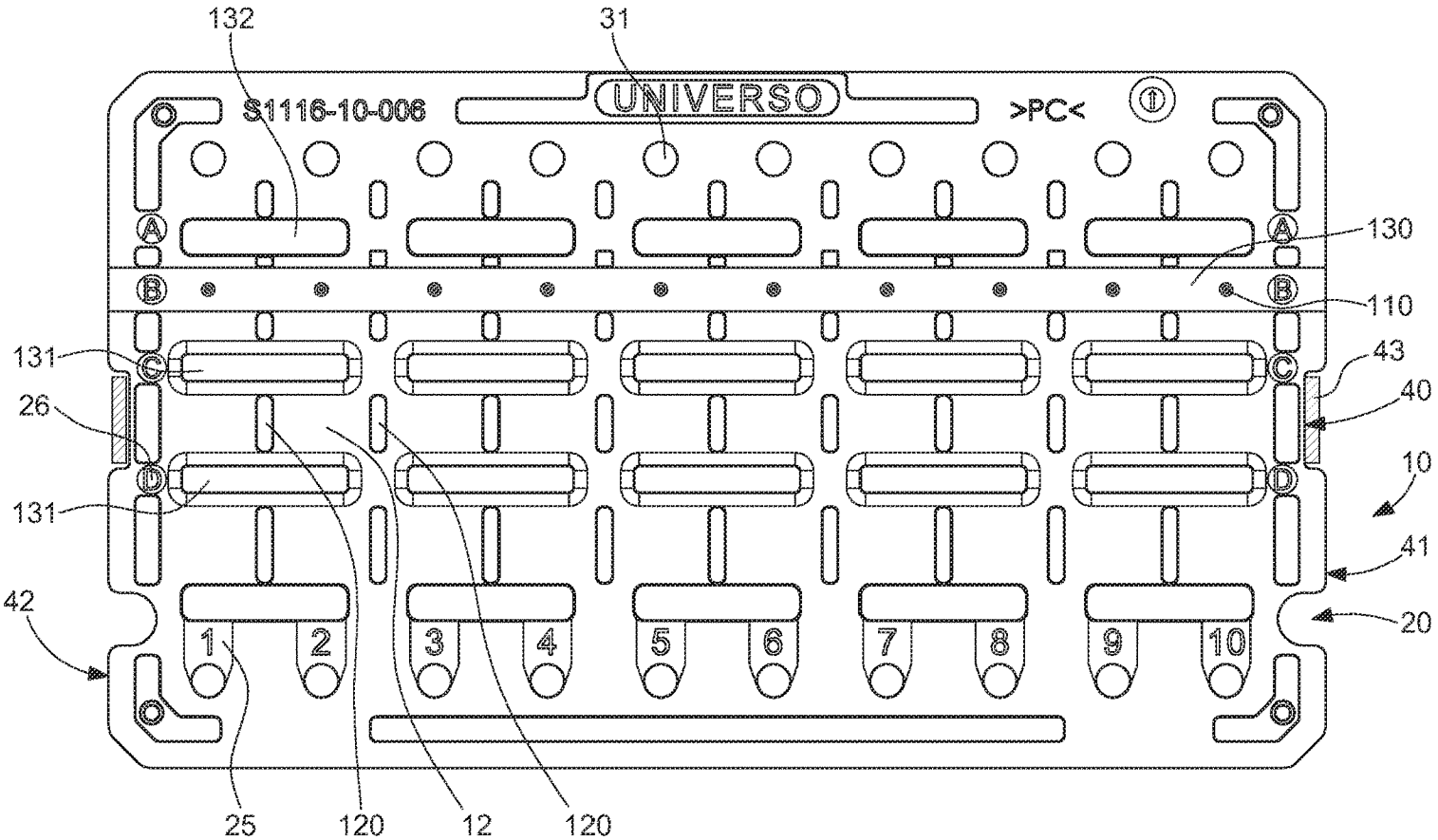
FIG. 13 diagrammatically shows an overhead view of the first alternative embodiment of the pallet in FIG. 3.
Figure 16:
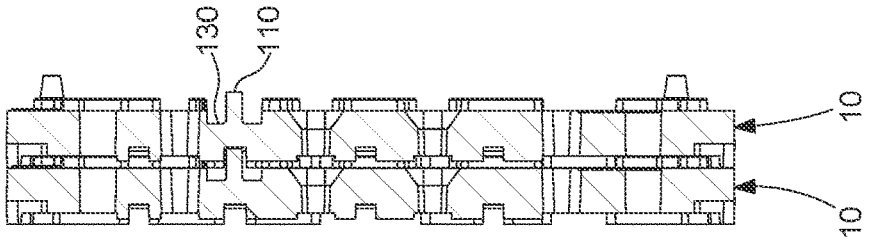
FIG. 16 diagrammatically shows a widthwise sectional view of an assembly of two pallets according to FIG. 15.
Figure 15:
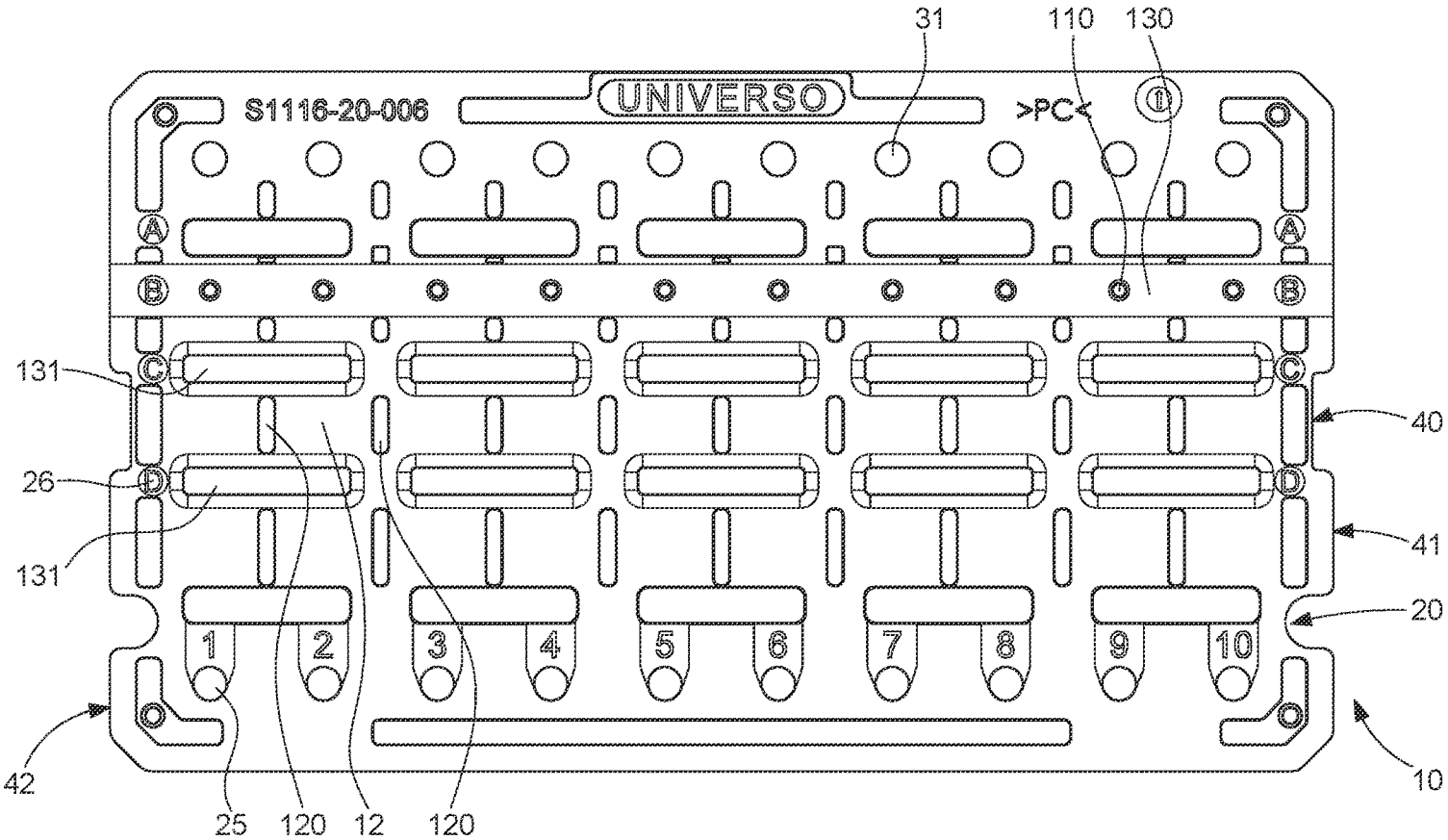
FIG. 15 diagrammatically shows an overhead view of a third alternative embodiment of a pallet.

The invention proposes developing a packaging which, from the initial shaping operation, generally carried out by machining, but which can also come from foundry or three-dimensional printing methods, for the hands or small display components for timepieces having a shape that is similar to that of hands, provides for the collection of the blanks, the intermediate storage thereof during all operations in the manufacturing process thereof, these components preferably remaining permanently on the packaging tool according to the invention once initial shaping has been carried out.

For the sake of simplicity, the term "manufacturing operation" will be used hereafter to refer to the first shaping operation, whether it is carried out by adding material (foundry, 3D printing, welding), or by removing material using a cutting tool (stamping and/or milling and/or diamond cutting) or by abrasion (grinding), or by both adding and then removing material.

The "hand 2" will be used to refer to a small display component comprising at least one pipe, bearing an indicator strip, referred to as a "hand body 5", extending substantially radially in a plane passing through the axis of the pipe. Such a hand 2 can further comprise a counterpoise 6 extending diametrically opposite this hand body 5, and which is weightier and has a smaller radial amplitude than that of the strip. The hand body 5 can be straight or curved.

The invention relates to a conditioning 1 for clock hands 2.

A hand 2 comprises at least one pipe 4 defining a hand axis D, a bearing surface 3 connected to the pipe 4 and substantially perpendicular to the hand axis D, and a hand body 5 that is substantially radial relative to the pipe 4. The most common hands comprise a single pipe 4. Some deformable hands can comprise at least two pipes, as described in the European patent document No. 286327461. The hand height is the maximum dimension of a hand, in the direction of the hand axis D thereof, above the bearing surface 3 thereof.

This packaging 1 comprises at least one pallet 10 which is provided for receiving, holding, storing and carrying such hands 2; preferably but in a non-limiting manner, a given pallet 10 is provided for hands 2 of the same height in the direction of the axis D, and even more particularly, for hands 2 of the same type. This pallet 10 comprises a series of receptacles, in particular constituted by bores 11, or trunnions 110, for receiving such pipes 4, and preferably according to a constant pitch. Each receptacle or bore 11 or trunnion 110 is adjacent to a recess 12, which is arranged to house a hand body 5, bearing against an upper pallet surface 13, opposite a lower pallet surface 14 situated on the opposite face of the pallet considered.

According to the invention, these recesses 12 are parallel to one another, each being arranged to receive such a hand 2 in a longitudinal direction DL of the pallet 10. Each recess 12 is delimited by at least two lateral stops 120 in a transverse direction DT perpendicular to the longitudinal direction DL and to the hand axes D. Moreover, at least one pallet 10 comprises at least one transverse bearing surface 130, which is arranged to receive all of the bearing surfaces 3 of a series of hands 2, and which is oriented in the transverse direction DT. This at least one pallet 10 comprises, substantially parallel to this transverse bearing surface 130 and on a first side thereof, first oblong pieces 131, the width whereof in the longitudinal direction DL is adapted for the insertion of robotic grippers or of tweezers for loading or unloading such hands.

More particularly, the width of these first oblong pieces 131 is greater than or equal to 1.0 mm. Even more particularly, the width of these first oblong pieces 131 is greater than or equal to 1.4 mm.

These first oblong pieces 131 are further arranged to limit, as far as possible, any capillary plating of the hands 2 on the upper pallet surface 13, which would be detrimental to the handling of the hands 2, so as to facilitate the deposition or retrieval of the hands 2 by a vacuum handling means, and to facilitate the passage of leaching fluids and/or the application of certain treatments, such as PVD, galvanisation, or other treatments, on the hands 2 deposited on this at least one pallet 10, through the thickness of this pallet 10.

More particularly, this transverse bearing surface 130 is continuous and planar between the bores 11 or respectively the trunnions 110 comprised therein.

More particularly, the length of each first oblong piece 131, in the transverse direction DT, is greater than or equal to the total length of at least two adjacent recesses 12.

Even more particularly, the width of each first oblong piece 131, in the longitudinal direction DL, is greater than or equal to 1.5 mm.

More particularly, at least one pallet 10 comprises, substantially parallel to the transverse bearing surface 130 and on a second side thereof that is opposite the first side, second oblong pieces 132, the width whereof in the longitudinal direction DL is adapted for the insertion of robotic grippers or of tweezers for loading or unloading hands 2 by the counterpoise 6 if these hands 2 are provided therewith. These second oblong pieces 132 are further arranged to limit capillarity plating of the hands 2 on the upper pallet surface 13 so as to facilitate the deposition thereof or the retrieval thereof by a vacuum handling means, and to facilitate the passage of leaching fluids and/or the application of certain treatments on the hands 2 deposited on this at least one pallet 10.

More particularly, the length of each said second oblong piece 132, in the transverse direction DT, is greater than or equal to the total length of at least two adjacent recesses 12.

Even more particularly, the width of each second oblong piece 132, in the longitudinal direction DL, is greater than or equal to 1.5 mm.

Advantageously, each pallet 10 comprises position indexing means 20, to ensure the precise positioning thereof relative to a production means and/or a handling means.

Additionally and more particularly, each pallet comprises at least one spacer 15, which extends in a vertical direction (i.e. parallel to the direction of threading of the pipes 4 in the receptacles or bores 11 thereof, which is itself parallel to the hand axes D), and which is arranged to co-operate such that it bears against a lower pallet surface 14 of another pallet 10, or against a lower skid surface of a skid which is comprised in the packaging 1. Such a skid has the same overall planar dimensions as a pallet 10, and can be necessary to hold the hands 2 disposed on the upper pallet 10 in a stack of pallets.

Each spacer 15 in particular extends from the upper pallet surface 13 over a pallet height which exceeds the hand height by the value of a predefined functional clearance J, which is in particular but not limited to in the order of at least 0.05 mm. These spacers 15 can be formed by edges surrounding the pallet 10, in particular angled edges as seen in the figures, or discreet projections distributed over the upper surface thereof.

Some of these spacers 15 can also form positioning pieces guaranteeing that pallets are stacked in a particular direction and preventing head-to-toe stacking. For example, an angled edge can have larger dimensions than the others, in particular at a projection 16, paired with a recess 17 having a matching profile on the opposite face.

Figure 17:
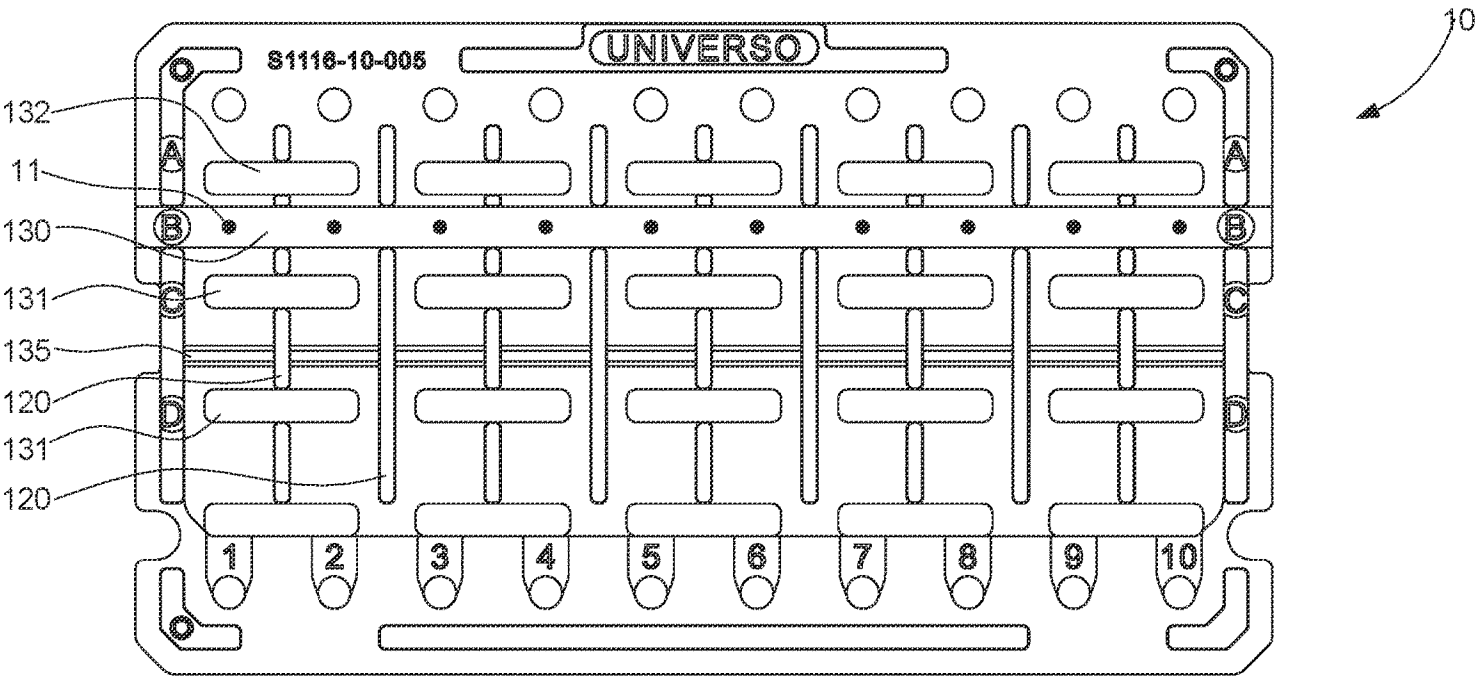
FIG. 17 diagrammatically shows an overhead view of a fourth alternative embodiment of a pallet for cambered hands such as those shown in FIG. 18, or curved hands such as those shown in FIG. 19.
Figure 18:
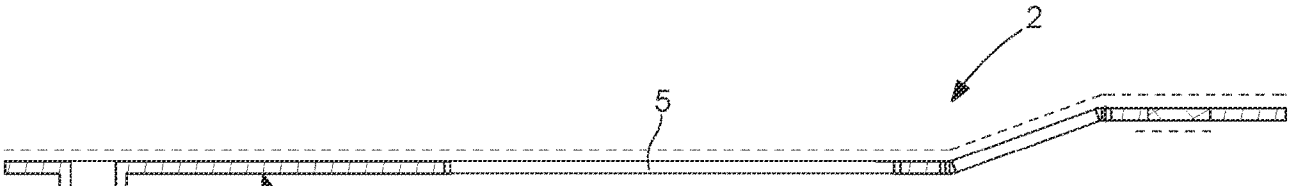
Figure 19:
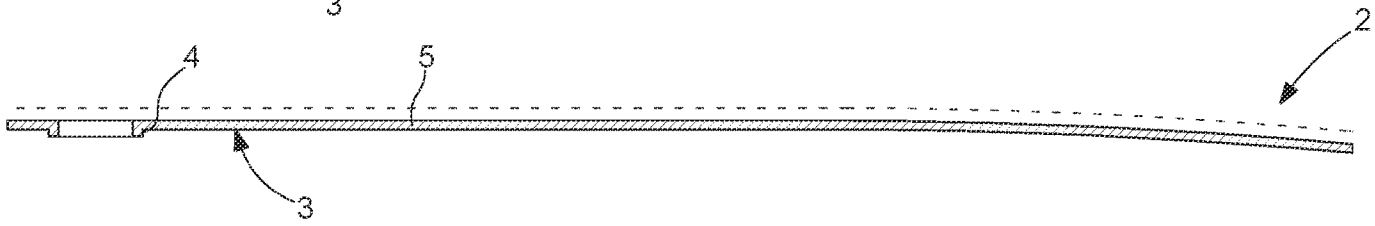
Figure 21:
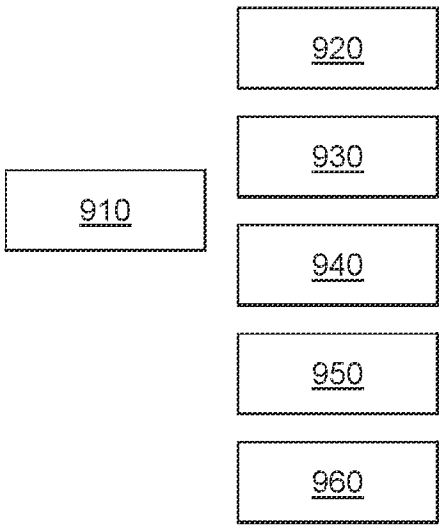
FIG. 21 shows, in the form of a block diagram, the operations of a hand manufacturing method, comprising the steps of preparing packaging, preparing raw materials, manufacture, surface treatment, washing, and inspection.
Figure 20:
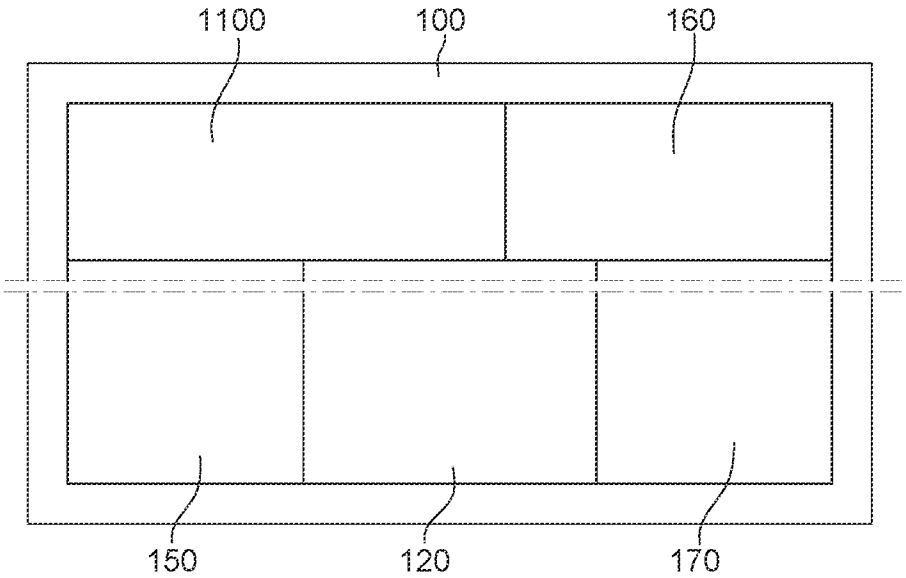
FIG. 20 shows, in the form of a block diagram, an automated production means which comprises, fed by a palletiser associated with identification means, a machining shaping unit, processing and washing equipment, and an inspection and control station.

More particularly, as shown in FIG. 17, at least one pallet 10 comprises, substantially parallel to the transverse bearing surface 130, a clearance pocket 135 or a succession of clearance pockets 135 for housing the distal ends of bent hands 2 according to FIG. 18 or curved hands according to FIG. 19.

More particularly, at least one pallet 10 comprises, in the transverse direction DT, at least one series of bores 11 or respectively of trunnions 110 according to a constant pitch.

More particularly, each pallet 10 and/or skid lies within a rectangle in each plane perpendicular to the direction of the hand axes D.

Preferably, the packaging 1 comprises a plurality of the same pallets 10, each having identical overall planar dimensions to one another. Thus, rigid connection of such pallets by stacking ensures the comprehensive protection of all of the hands contained therein.

In one specific embodiment shown by the figures, each pallet 10 and/or said skid lies within a rectangle in each plane perpendicular to the direction of the hand axes D.

In a specific alternative embodiment allowing the pallets 10 of the same stack to be precisely positioned in space relative to one another, or even neighbouring pallets to be clipped to one another, at least one pallet 10, and more particularly each pallet of a stack, comprises, extending beyond each spacer 15 from the upper pallet surface 13, at least one clipping or centring pin 16, which is arranged to cooperate with a clipping or centring installation 17, comprised in a lower pallet surface 14 of another pallet 10, or a lower skid surface forming part of a skid.

Various planar arrangements of the pallet can be produced. In a specific alternative embodiment, at least one recess 12, or more particularly each recess 12, is separated from the adjacent recesses 12 by at least one lateral stop 120, which is interrupted at each first oblong piece 131 comprised in the pallet 10 concerned. This separation can also be achieved by means of bosses, which can themselves form spacers 15. More particularly, at least one such lateral stop 120 is interrupted at every second oblong piece 132 comprised in the pallet 10 concerned.

To facilitate production management, in an advantageous alternative embodiment, at least one, or more particularly each pallet 10 and/or skid comprises means 50 for identifying the size thereof, capable of being read by an automatic, optical, magnetic, inductive, mechanical or other sensing means, and/or of being recognised by an operator, in particular by way of a coloured and/or identification marking; the pallet 10 can, in particular, be made entirely in a colour enabling the identification thereof. In particular, these identification means 50 comprise at least one coloured pin, characteristic of the type of pallet or type of hand 2 that can be fitted into the pallet 10 considered, inserted into a perforation 31 comprised in the upper pallet surface 13. The identification means 50 can further consist of an RFID chip embedded in the material of the pallet, or other component, allowing the lot to be identified and traced, while providing a guarantee of origin to the customer.

Preferably, at least one, or more particularly each pallet 10 and/or skid is entirely made of a material that is insensitive and resistant to the treatments included in the manufacturing process of the hands 2 concerned, for example a plastic material or a material prepared for this purpose, for example polycarbonate in the event of cold treatment operations.

More particularly, and in a safe and cost-effective manner, the packaging 1 comprises a plurality of pallets 10 and/or skids of the same overall planar dimensions, each comprising at least two cut-outs 40 made on the faces of opposite edges 41, 42, and arranged to receive at least one elastic strap 43 or clamping means arranged to temporarily rigidly connect all of the pallets resting one on top of the other. More particularly, this packaging 1 thus solely comprises a plurality of identical pallets 10 and at least one such elastic strap 43. It is thus easy to group a large production of hands of a given model into a low volume. Preferably, the elastic strap 43 is made of a latex- and sulphur-free material without degassing.

In an advantageous alternative embodiment, at least one, or more particularly each pallet 10 and/or skid comprises, in addition to the first oblong pieces 131 and the second oblong pieces 132, a plurality of other hollows which are arranged to allow fluid to pass through the thickness thereof. In an alternative embodiment, for at least one, or more particularly for each pallet 10, each bore 11 is distant from at least one such hollow by a value that is less than or equal to the constant pitch between the bores 11.

The pallets 10 shown comprise markings 25 in the transverse direction DT, and 26 in the longitudinal direction DL, which make it easy to designate the position of a bore 11 or of a trunnion 110 by the Cartesian coordinates thereof according to this coordinate system, for example 5B or 6A, which simplifies the programming of a position, or the designation of a defective hand, and the like.

The invention further relates to an automated production means 100 for manufacturing such clock hands 2.

This automated production means 100 comprises at least one manufacturing and initial shaping unit, in particular a stamping and/or milling and/or diamond cutting manufacturing unit 1100, or a manufacturing unit implementing another manufacturing station that is adapted to the execution of a hand-manufacturing operation.

According to the invention, this automated production means 100 further comprises a palletiser mechanism 120, which is arranged to receive and identify a pallet 10 intended for receiving, holding, storing and carrying hands 2 having the same hand height, and which comprises position indexing means 20 for the precise positioning thereof on this palletiser mechanism 120.

Advantageously, this palletiser mechanism 120 comprises at least one automated sensing means 150, which is arranged to identify identification means 50 comprised in each pallet 10.

In a specific alternative embodiment, the automated production means 100 comprises surface treatment means 160 for treating hands 2 held in position on pallets 10 after the shaping or machining thereof.

In a specific alternative embodiment, the automated production means 100 comprises control and/or inspection means 170 for inspecting hands 2 held in position on pallets 10 after the shaping or machining thereof.

The invention further relates to a method for manufacturing such clock hands 2.

The method comprises:

- a step 910 of procuring, for each manufacturing lot of hands 2 of a given hand height, at least one such packaging 1 adapted to this size;
- a step 920 of procuring the raw material that can be used by such an automated production means 10;
- a step 930 at least of machining the hands 2 on such an automated production means 100, which deposits the machined hands 2 on at least one pallet 10 of adequate dimensions;

a step 950 of washing, at least once, the machined hands 2 in position on the pallet 10 thereof;

a step 960 of inspecting the hands 2 in position on the pallet 10 thereof.

More particularly, after washing and before final inspection, in a step 940, at least one surface treatment and/or treatment for coating in a surrounding layer is carried out on these machined hands 2 held in position on the pallet 10 thereof.

In a specific manner, different versions of the pallets 10 can be produced, which in particular differ through:

the centre-to-centre distance of the pipe receiving bores, in particular with values comprised between 4.5 mm and 8.5 mm;

the diameter of these bores, in particular with values comprised between 0.4 mm and 0.6 mm;

the height of the spacers 15, defining the distance between the functional surfaces of two successive pallets, to maintain the quality of the hand bodies, in particular with spacing values comprised between 0.35 mm and 1.1 mm;

the means for identifying in particular the colour, for fast identification by the preparation operators.

The use of such pallets 10 is advantageous, as it allows:

them to be used directly on a manufacturing means thanks to a palletiser, which avoids the need to put the hands back into bulk storage after manufacture, thus allowing easy storage throughout the entire manufacturing process;

the hands to be held without requiring any direct pressure on the hand body, such pressure often resulting in appearance defects: in this case, the hands are held by gravity, and the axial motion of the hands is limited thanks to the lateral stops; each hand is thus held independently, without contact with neighbouring hands;

the hands to be handled by a robotic manipulator, thanks to the oblong pieces providing a passage for the gripping tools;

a pallet thickness greater than that of the paper cards of the prior art to be chosen, and in particular in the order of 3 to 5 mm, which increases the rigidity of the pallet, which is required for reliable handling, as well as to allow hands to be corrected directly on the pallet which constitutes a rigid bearing surface allowing the geometrical configuration to be reworked without deterioration;

the pallet and the contents thereof to be optionally turned over on a planar surface, in order to carry out an operation on the bearing surface of the hands, and then all of the hands to be grasped via the same pallet before being turned over;

the machine to have an increased autonomy, with a sufficiently supply for one production lot by equipping same with a full pallet;

the hands to be washed, or undergo surface treatment, or undergo heat treatment, or another process, directly on the pallets;

the hands to be inspected directly on the pallets;

a large quantity of hands to be held under good conditions, at least ten in the examples shown by the figures; the same pallet further allows a plurality of rows of small hands to be arranged, thus allowing several tens of hands to be stored.

More specifically, once the hands have been removed from the production means, which give them their initial shape, they no longer leave the pallet, in order to minimise handling costs and to preserve, as far as possible, the aesthetic quality of the product until delivery to the customer.

The invention can also be used for other horological components aside from hands, such as counter discs, which can be inserted onto trunnions and the like.

The figures show four alternative embodiments of the pallets, which alone are sufficient to cover at least 90% of the production of a clock hand manufacturer, allowing the hands to be correctly deposited by the end geometrical configurations.

The invention claimed is:

1. A packaging (1) for clock hands (2), each of said hands (2) comprising at least one pipe (4) defining a hand axis (D), and a bearing surface (3) connected to said pipe (4) and substantially perpendicular to said hand axis (D), and at least one hand body (5) that is substantially radial relative to each said pipe (4), said packaging (1) comprising at least one pallet (10) provided for receiving, holding, storing and carrying said hands (2), said at least one pallet (10) comprising a series of bores (11) or trunnions (110) for receiving said pipes (4) and a plurality of recesses for receiving said hands, each of said bores or respective trunnions being adjacent to an associated one of said recesses arranged to house one said hand body (5) resting on an upper pallet surface (13) which is opposite a lower pallet surface (14) situated on the opposite face of said at least one pallet (10), wherein said recesses (12) are parallel to one another, each being arranged to receive a said hand (2) in a longitudinal direction (DL) of said pallet (10), each recess (12) of said plurality of recesses being delimited by at least two lateral stops (120) in a transverse direction (DT) perpendicular to said longitudinal direction (DL) and to said hand axes (D), wherein at least one said pallet (10) comprises at least one transverse bearing surface (130) arranged to receive all of said bearing surfaces (3) of a series of said hands (2) and oriented in said transverse direction (DT), and, substantially parallel to said transverse bearing surface (130) and on a first side thereof, first oblong pieces (131) having a width in said longitudinal direction (DL) which is configured for the insertion of robotic grippers or of tweezers for loading or unloading said hands (2), and which are arranged to facilitate the deposition of said hands by a vacuum handling means, and to facilitate the passage of leaching fluids and/or the application of certain treatments on said hands (2) deposited on said at least one pallet (10), through a thickness of the pallet.

2. The packaging (1) according to claim 1, wherein said transverse bearing surface (130) is continuous and planar between said bores (11) or respectively trunnions (110) comprised therein.

3. The packaging (1) according to claim 1, wherein a length of each said first oblong piece (131), in said transverse direction (DT), is greater than or equal to a total length of at least two said adjacent recesses (12).

4. The packaging (1) according to claim 1, wherein the width of each said first oblong piece (131), in said longitudinal direction (DL), is greater than or equal to 1.5 mm.

5. The packaging (1) according to claim 1, wherein at least one said pallet (10) comprises, substantially parallel to said transverse bearing surface (130) and on a second side thereof that is opposite said first side, second oblong pieces (132) having a width in said longitudinal direction (DL) which is configured for the insertion of robotic grippers or of tweezers for loading or unloading said hands (2) by the counterpoise (6) if said hands (2) are provided therewith.

6. The packaging (1) according to claim 5, wherein a length of each said second oblong piece (132), in said transverse direction (DT), is greater than or equal to a total length of at least two said adjacent recesses (12).

7. The packaging (1) according to claim 5, wherein the width of each said second oblong piece (132), in said longitudinal direction (DL), is greater than or equal to 1.5 mm.

8. The packaging (1) according to claim 1, wherein at least one said pallet (10) comprises position indexing means (20) and comprises at least one spacer (15) which extends in a vertical direction and which is arranged to co-operate such that it bears against a said lower pallet surface (14) of another said pallet (10), each said spacer (15) extending, from said upper pallet surface (13), over a pallet height (HP) which exceeds the maximum axial overall dimensions of each said hand (2) above said bearing surface (3) thereof, by the value of a predefined functional clearance (J).

9. The packaging (1) according to claim 1, wherein at least one said pallet (10) comprises, substantially parallel to said transverse bearing surface (130), a clearance pocket (135) or a succession of clearance pockets (135) for housing the distal ends (53) of said bent or curved hands (2).

10. The packaging (1) according to claim 1, wherein at least one said pallet (10) comprises, in said transverse direction (DT), at least one series of said bores (11) or respectively of said trunnions (110) according to a constant pitch.

11. The packaging (1) according to claim 1, wherein each said pallet (10) lies within a rectangle in each plane perpendicular to the direction of said hand axes (D).

12. The packaging (1) according to claim 1, wherein at least one said pallet (10) comprises, extending beyond each said spacer (15) from said upper pallet surface (13), at least one clipping or centring pin (16) arranged to cooperate with a clipping or centring installation (17) comprised in a said lower pallet surface (14) of another said pallet (10).

13. The packaging (1) according to claim 1, wherein each said recess (12) is separated from said adjacent recesses (12) by at least one said lateral stop (120), which is interrupted at each said first oblong piece (131) comprised in said pallet (10) concerned.

14. The packaging (1) according to claim 5, wherein each said recess (12) is separated from said adjacent recesses (12) by at least one said lateral stop (120), which is interrupted at each said second oblong piece (132) comprised in said pallet (10) concerned.

15. The packaging (1) according to claim 1, wherein each said pallet (10) comprises means (50) for identifying the size thereof, capable of being read by an automated sensing means, and/or of being recognised by an operator, and/or at least one coloured pin, characteristic of the type of pallet or type of hand that can be received, inserted into a perforation (31) comprised in said upper pallet surface (13).

16. The packaging (1) according to claim 1, wherein each said pallet (10) is entirely made of a material that is insensitive and resistant to the treatments included in the manufacturing process of said hands (2).

17. The packaging (1) according to claim 1, wherein said packaging (1) comprises a plurality of said pallets (10) of the same overall planar dimensions, each comprising at least two cut-outs (40) made on faces of opposite edges (41; 42), and arranged to receive at least one elastic strap (43) or clamping means arranged to temporarily rigidly connect all of said pallets resting one on top of the other.

18. The packaging (1) according to claim 17, wherein said packaging (1) solely comprises a plurality of said identical pallets (10) and at least one said elastic strap (43).

19. An automated production device (100) for producing and/or packaging clock hands (2), said hands (2) comprising, on either side of a bearing surface (3), a pipe (4), and a hand body (5) which extends over a hand height (HA) above said bearing surface (3), said automated production device (100) comprising at least one manufacturing unit (1100), wherein said automated production device (100) comprises a palletiser mechanism (120), which is arranged to receive and identify a pallet (10) of the packaging (1) according to claim 1, intended for receiving, holding, storing and carrying said hands (2) having the same said hand height, and which comprises position indexing means (20) for the precise positioning thereof on said palletiser mechanism (120).

20. The automated production device (100) according to claim 19, wherein said palletiser mechanism (120) comprises at least one automated sensing means (150) arranged to identify identification means (50) comprised in each said pallet (10) of a packaging (1), wherein each said pallet (10) comprises means (50) for identifying the size thereof, capable of being read by an automated sensing means, and/or of being recognised by an operator, and/or at least one coloured pin, characteristic of the type of pallet or type of hand that can be received, inserted into a perforation (31) comprised in said upper pallet surface (13).

21. The automated production device (100) according to claim 19, wherein said automated production device (100) comprises surface treatment means (160) for treating the surface of said hands (2) held in position on said pallets (10).

22. The automated production device (100) according to claim 19, wherein said automated production device (100) comprises means (170) for controlling and/or inspecting said hands (2) held in position on said pallets (10) after the machining thereof.

23. A method for manufacturing clock hands (2), each of said hands (2) comprising at least one pipe (4) defining a hand axis (D) and a bearing surface (3) connected to said pipe (4) and substantially perpendicular to said hand axis (D), and at least one hand body (5) that is substantially radial relative to each said pipe (4), wherein, for each manufacturing lot of said hands (2) of a given hand height, at least one packaging (1) is procured according to claim 1, and in that raw material that can be used by an automated production device (100) is procured, said automated production device (100) for producing and/or packaging clock hands (2), said hands (2) comprising, on either side of a bearing surface (3), a pipe (4), and a hand body (5) which extends over a hand height (HA) above said bearing surface (3), said automated production device (100) comprising at least one manufacturing unit (1100), and said automated production device (100) comprising a palletiser mechanism (120), which is arranged to receive and identify a pallet (10) of the packaging (1), intended for receiving, holding, storing and carrying said hands (2) having the same said hand height, and which comprises position indexing means (20) for the precise positioning thereof on said palletiser mechanism (120), in that at least the manufacture of said hands on a said automated production device (100) is carried out, which deposits said machined hands (2) on at least one said pallet (10) of adequate dimensions, in that at least one washing process is carried out for said machined hands (2) in position on said pallet (10) thereof, and in that an inspection is carried out of said hands (2) in position on said pallet (10) thereof.

24. The manufacturing method according to claim 23, wherein, after washing and before final inspection, at least one surface treatment and/or treatment for coating in a surrounding layer is carried out on said machined hands (2) held in position on said pallet (10) thereof.

* * * * *